US005332359A

United States Patent [19]

Palgon et al.

[11] Patent Number: 5,332,359

[45] Date of Patent: Jul. 26, 1994

[54] STATOR ASSEMBLY FOR A ROTARY MACHINE HAVING A CENTRIFUGAL ON IMPELLER AND VOLUTE

[75] Inventors: Alfred M. Palgon, Coral Springs; Jerry H. Moore, Palm Beach Gardens, both of Fla.

[73] Assignee: United Technologies Corporation, Hartford, Conn.

[21] Appl. No.: 134,726

[22] Filed: Oct. 12, 1993

[51] Int. Cl.[5] ..... F01D 9/00

[52] U.S. Cl. ..... 415/182.1; 415/208.3; 417/423.14

[58] Field of Search ..... 415/182.1, 206, 208.1, 415/208.2, 208.3; 417/423.14

[56] References Cited

U.S. PATENT DOCUMENTS

| | | | |
|---|---|---|---|
| 2,876,946 | 3/1959 | Hornschuch | 415/206 |
| 4,383,800 | 5/1983 | Becker et al. | 415/206 |
| 4,564,334 | 1/1986 | Hergt et al. | 415/208.2 |

*Primary Examiner*—John T. Kwon

*Attorney, Agent, or Firm*—Gene D. Fleischhauer

[57] ABSTRACT

A centrifugal pump 10 having a centrifugal impeller 12 and a volute housing 56 for collecting flow discharged from the impeller is disclosed. Various construction details are developed which decrease stresses in the components and improve the efficiency of the construction. In one particular embodiment, the volute housing is formed inwardly of the pressure vessel 32 and has at least one sidewall 64 having a pressure region 58 bounded by the sidewall on the interior side of the pressure region and bounded by the outer pressure vessel on the exterior side of the pressure region to exert a pressure force on the sidewall under operative conditions.

14 Claims, 3 Drawing Sheets

STATOR ASSEMBLY FOR A ROTARY MACHINE HAVING A CENTRIFUGAL ON IMPELLER AND VOLUTE

TECHNICAL FIELD

This invention relates to a stator assembly for a rotary machine, such as a pump having a centrifugal impeller. The stator assembly includes a manifold housing or volute which extends circumferentially about the centrifugal impeller. Although this invention was developed in the field of rocket engines, it is applicable to any machine having a centrifugal impeller and a volute which extends circumferentially about the impeller.

BACKGROUND ART

A rocket engine for a spacecraft, such as the space shuttle, burns liquid oxygen and liquid fuel to form a stream of hot, propulsive gases. These fluids are mixed and burned in a combustion chamber to produce energy for propelling the spacecraft. The rocket engine includes a centrifugal pump for supplying liquid oxygen to either an intermediate burner or to the main combustion chamber.

One example of such a centrifugal pump is shown in U.S. Pat. No.: 5,156,534 issued to Burgy, Palgon, and Branstrom. In this example, an impeller forces the liquid into rotary motion. A pump casing extends circumferentially about the impeller and has a volute or manifold housing for receiving flow discharged from the centrifugal impeller. A discharge passage or nozzle is in flow communication with the volute to discharge flow from the pump casing.

The walls of the pressure vessel which form the volute have a plurality of circumferentially extending vanes. The vanes extend between the walls of the pump housing to aid in the collection of the dynamic flow. The vanes aid in turning the flow into static pressure for eventual discharge through the nozzle.

The pump discharges a very high pressure in rocket engines. The leading edge of the radially or circumferentially extending vane, commonly called the "cutwater", is subjected to large tensile forces by reason of the walls being forced apart by the pressure on the interior of the volute or pump housing. As a result, the leading edge must have an acceptable thickness to lower the stress in the leading edge region. The increase in thickness results in bluntness in the leading edge region which decreases pump performance.

The use of radially or circumferentially extending vanes on the interior of the volute and the precise control of the thickness of the vane results in a complex shape on the interior of the pump housing. The pump housing, having this complex shape, lends itself to casting as the preferred method of manufacturing of the pump housing. This places some limitations on the material that is used, particularly in strength and in fatigue life of the structure.

Accordingly, scientists and engineers working under the direction of Applicant's Assignee have sought to develop a stator assembly for a centrifugal pump which reduces tensile stresses in the leading edge of radially or circumferentially extending vanes and need not be entirely of a cast construction.

DISCLOSURE OF INVENTION

This invention is, in part, predicated on recognizing that the stator assembly for a rotary machine having a centrifugal impeller may be formed of a pressure vessel and a volute which is at least in part structurally isolated from the pressure vessel.

According to the present invention, a stator assembly for a rotary machine having a centrifugal impeller includes a pressure housing for containing pressurized fluid discharged from the impeller and a volute housing which is on the interior of the pressure vessel and which is at least in part structurally isolated from the pressure vessel.

In accordance with one embodiment of the present invention, the volute housing includes a pair of radially extending sidewalls which are spaced axially to form a passage for receiving fluid discharged from the centrifugal impeller, the volute housing including at least one circumferentially extending vane extending axially between the walls, the walls being urged axially toward each other under operative conditions to reduce tensile stresses in the axially extending vane.

In accordance with one detailed embodiment of the present invention, the pressure vessel and the volute housing are each free-standing structures, the pressure vessel being a forged construction and the volute housing being a cast construction.

A primary feature of the present invention is a stator assembly of a rotary machine which extends circumferentially about a centrifugal impeller. The stator assembly has an outer pressure vessel. The pressure vessel extends circumferentially about an axis $A_r$ and is spaced radially from the impeller, leaving a cavity therebetween. A volute (manifold) housing is disposed in the cavity. The volute housing is spaced axially from the stator assembly leaving a first pressure region between the volute housing and the stator assembly on one side of the volute housing and a second pressure region between the volute housing and the stator assembly on the other side of the volute housing. In one detailed embodiment, a primary feature of the present invention is means for placing the first pressure region and second pressure region in flow communications with the discharge region of the centrifugal impeller to exert a pressure on the interior of the pressure housing and on the exterior of the volute housing. Another primary feature is a circumferentially extending diffuser vane which extends axially between the sidewalls of the volute housing. Another feature is the leading edge of the diffuser vane. In one detailed embodiment, a passage to the sidewall of the volute housing places the first pressure region in flow communication with the discharge region of the centrifugal impeller.

A primary advantage of the present invention is the level of stress in the leading edge of the guide vane for a given level of sharpness which results from applying a compressive force to the axially extending guide vane either by pre-loading the sidewalls of the volute or exerting a pressure force on the sidewalls of the volute. Another advantage of the present invention is the ease of fabrication and the structural characteristics of the components which results from forming the outer pressure vessel by forging, the forging being done independently of the inner volute (manifold housing) and then forming the volute by casting. Forging allows the use of a high-strength material with improved life characteristics for the outer pressure vessel. Casting accommodates the complex geometry including vanes of the volute housing.

The forgoing features and advantages of the present invention will become more apparent in light of the following detailed description of the Best Mode For Carrying Out The Invention and the accompanying drawings.

BEST MODE FOR CARRYING OUT THE INVENTION

Figures 1, 1A:
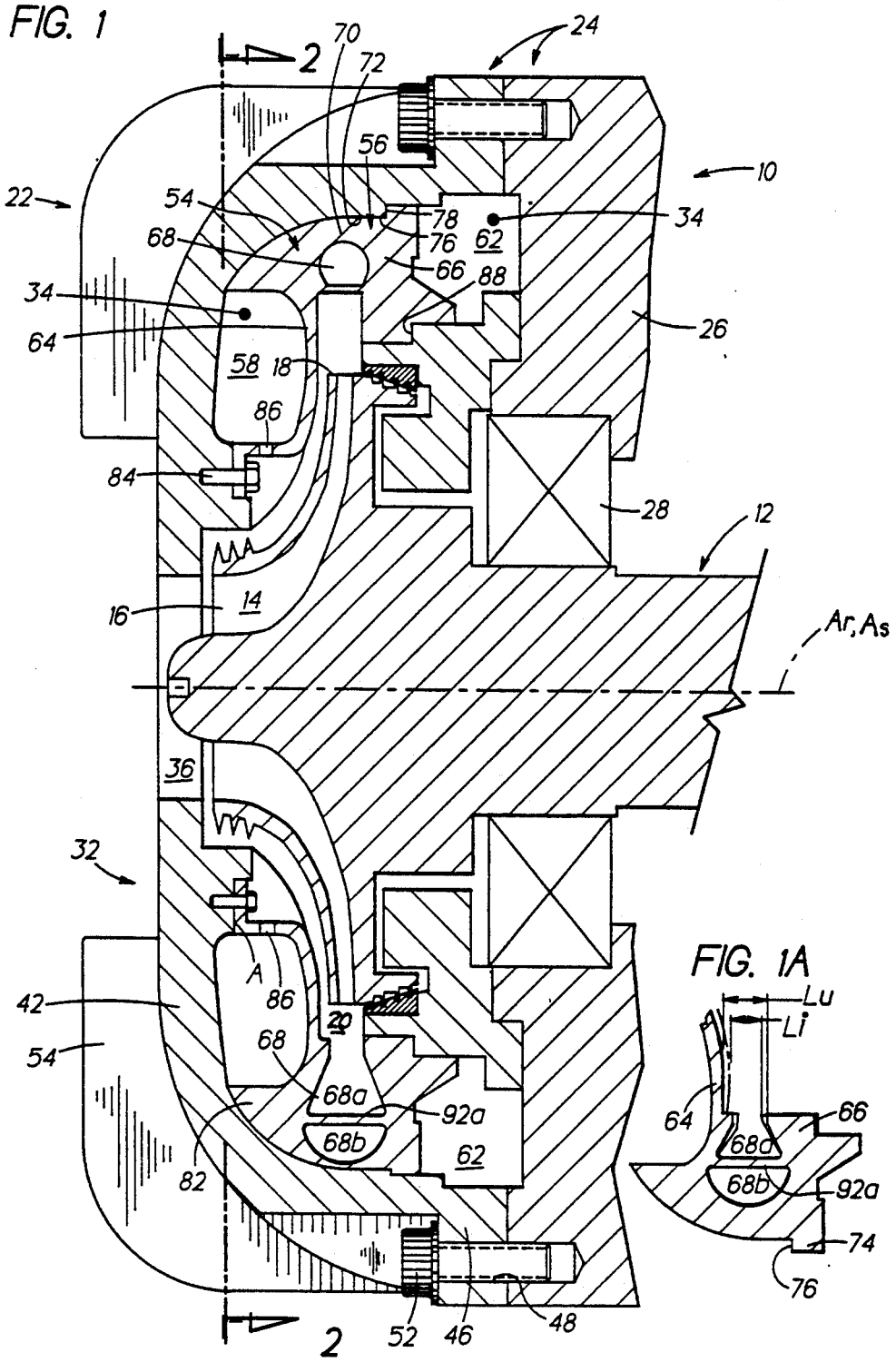
FIG. 1 is a side-elevation view of a rotary machine such as a high-pressure centrifugal pump, showing the centrifugal impeller and the stator assembly which extends circumferentially about the impeller and which includes a pressure vessel and a volute housing.
FIG. 1A shows an enlarged portion of the stator assembly.

FIG. 1 is a side-elevation view of a rotary machine such as a centrifugal pump 10 for a rocket engine. The pump has a centrifugal impeller 12 disposed about an axis rotation $A_r$. The impeller has a generally radially extending passage 14 having an inlet 16 and exit 18. A discharge region 20 for the impeller is in flow communication with the passage 14 in the impeller.

A stator assembly 22 is disposed about the impeller 12. The stator assembly includes a first portion 24 having a bearing support member 26 which is disposed circumferentially about the impeller. A bearing 28 is disposed between the bearing support member and the impeller to rotatably support the impeller.

The first portion 24 of the stator assembly includes an outer pressure vessel 32 extending circumferentially about the axis $A_r$. The pressure vessel is spaced radially from the centrifugal impeller leaving an annular cavity 34 therebetween. The pressure vessel includes an inlet passage 36 in flow communication with the radial passage 14 in the impeller. The pressure vessel includes a first exit passage through the exterior of the pressure vessel which is shown as the passage 38 in FIG. 3.

The pressure vessel 32 has a disk shaped member 42 disposed about the axis of $A_s$ and a cylindrically-shaped wall 44 which extends axially and circumferentially with respect to the disk shaped member. The wall terminates in a circumferentially extending flange 46. The flange is adapted by a plurality of bolt holes 48 to receive the bolts 52. The bolts engage the bearing support member 26 or another part of the first portion of the stator assembly. The pressure vessel has a plurality of reinforcing ribs 54. The reinforcing ribs project from the disk and from the circumferentially extending wall. The ribs are spaced circumferentially about the pressure vessel to reinforce the pressure vessel.

A second portion of the stator assembly is disposed in the annular cavity 34 between the outer pressure vessel 32 and the centrifugal impeller. The second portion includes a manifold housing or volute 56 extending circumferentially about the interior of the pressure vessel within the cavity. The volute divides the cavity into a first pressure region 58 and a second pressure region 62.

The manifold housing 56 has a first sidewall 64 and a second sidewall 66 extending radially and circumferentially about the housing. The walls are spaced apart by a distance $L_i$ in the installed condition (as shown in FIG. 1A) leaving a second exit passage 68 therebetween, which extends circumferentially. The second passage is in flow communication with the discharge region 20 of the impeller.

The manifold housing 56 includes a base 70 having an outwardly facing surface 72 which radially engages the outer pressure vessel 32 and is circumscribed by the pressure vessel. The base has a shoulder 74 having an axially facing surface 76 which faces in the direction of the disk member 42. The shoulder surface axially engages a corresponding surface 78 on the circumferentially extending wall 44 of the outer pressure vessel.

Figure 2:
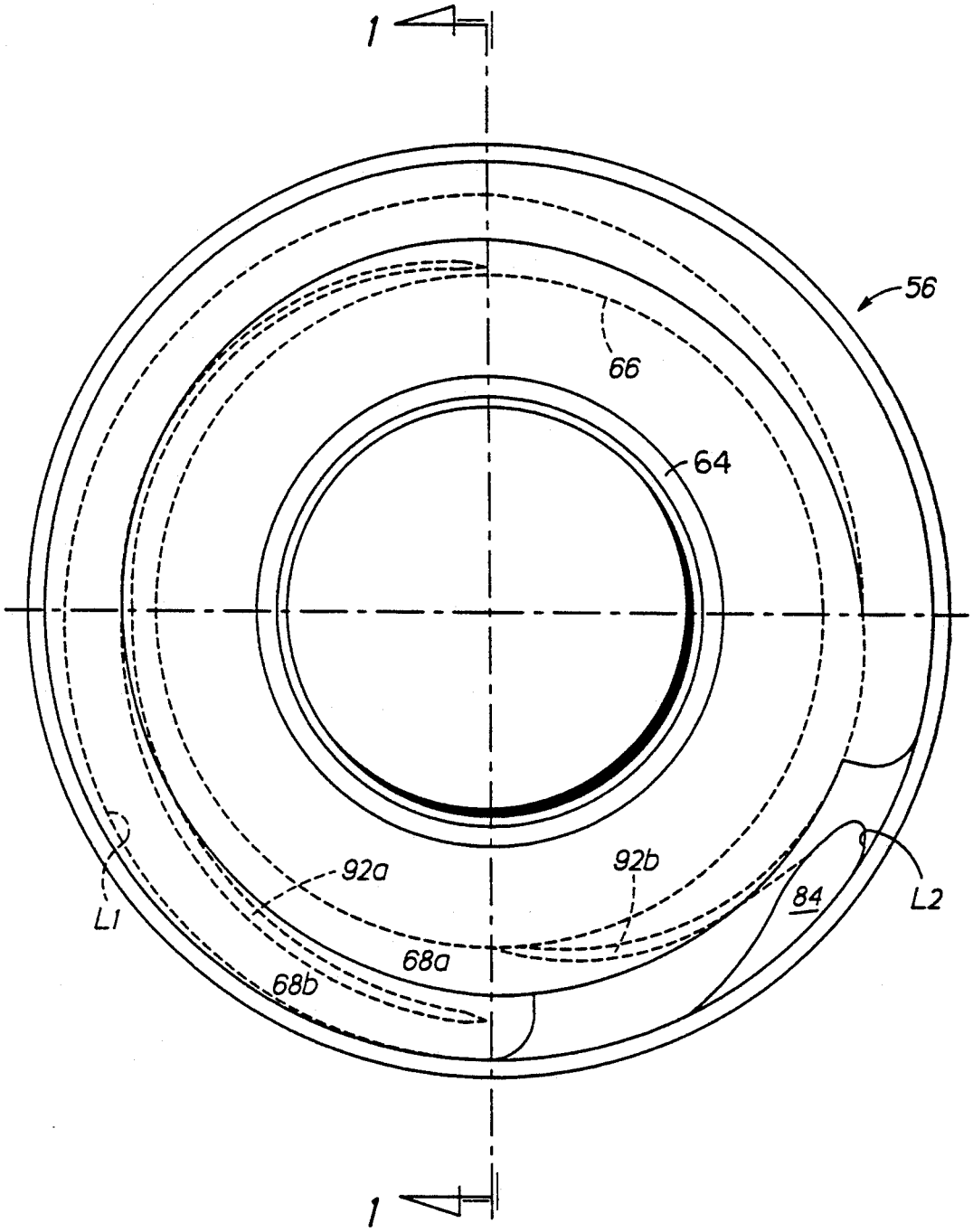
FIG. 2 is a side-elevation view taken generally along the lines 2—2, showing the outer diameter of the volute, circumferentially extending guide vanes, and a discharge cavity from the volute.

The manifold housing 56 includes a projection 82 which extends circumferentially about a portion of the manifold housing and extends axially from the base 70 to abuttingly engage the disk member 42 of the outer pressure vessel. The projection has a third passage 84 (shown in FIG. 2) extending through the projection. The third passage places the circumferentially extending second passage 68 in the manifold housing between the sidewalls in flow communication with the first (exit) passage 38 through the pressure vessel. The third passage is best shown in FIG. 2 and the shape of its outlet matches the shape shown in FIG. 3 of the entrance to the first passage.

As shown in FIG. 1, the first sidewall 64 of the manifold housing 56 extends radially inwardly from the base 70 of the manifold housing. The first sidewall engages the disk member 42 of the outer pressure vessel and is attached thereto by a plurality of bolts 84. The first sidewall is spaced axially from the disk member of the outer pressure vessel to bound a part of the first pressure region 58. An opening 86 through the first sidewall places the first pressure region in flow communication with the discharge region 20 of the impeller.

The second sidewall 66 extends radially inwardly from the base 70. The second sidewall has a shoulder 88 which faces in the direction away from the disk and abuttingly engages the first portion of the stator assembly to trap the manifold housing in the axial direction. The second sidewall is spaced axially apart of the first portion of stator assembly to bound part of the second pressure region 62. The second pressure region is in flow communication with the discharge region of the impeller through assembly clearances of the parts. The second region is vented through small holes in the bearing support member 26 (not shown) to direct the flow to another location of the rotary machine, such as a pump used to pressurize the fluid supplied to the inlet of the centrifugal impeller. In alternate embodiments, the second pressure region may not be vented to increase the pressure in the second region and the force exerted on the sidewall 66 of the manifold housing.

The manifold housing 56 includes one or more guide vanes, as represented by the guide vane 92, which is circumferentially oriented and which extends axially between the first sidewall and the second sidewall. The guide vane divides at least a portion of the second circumferentially extending passage in the manifold housing into an inner part 68*a* and an outer part 68*b*.

The manifold housing 56 is free standing in the non-installed condition. As shown in FIG. 1A at least one of the sidewalls, as represented by the first sidewall 64 and second sidewall 66 which are deflected relative to the other in the installed condition. As a result, the distance $L_u$ between walls in the non-installed condition is greater than the distance $L_i$ between the walls in the installed condition. This causes a compressive pre-stress in the guide vane 92 in the installed condition.

FIG. 2 is a view taken along the lines 2—2 of FIG. 1 with the outer pressure vessel 32 broken away to show the manifold housing 56 or volute. The sidewall 64, shoulder 74 and the projection 82 from the sidewall are shown in full with details on the interior of the volute shown by dotted lines.

For example, the outer diameter of the second passage 68 is shown by the dotted line $L_1$. The first guide vane 92*a* and second guide vane 92*b* are also shown by the dotted lines. The exit cavity 84 through the exterior of the manifold housing which places the exterior in flow communication with the second passage is shown by the solid line $L_2$.

Figure 3:
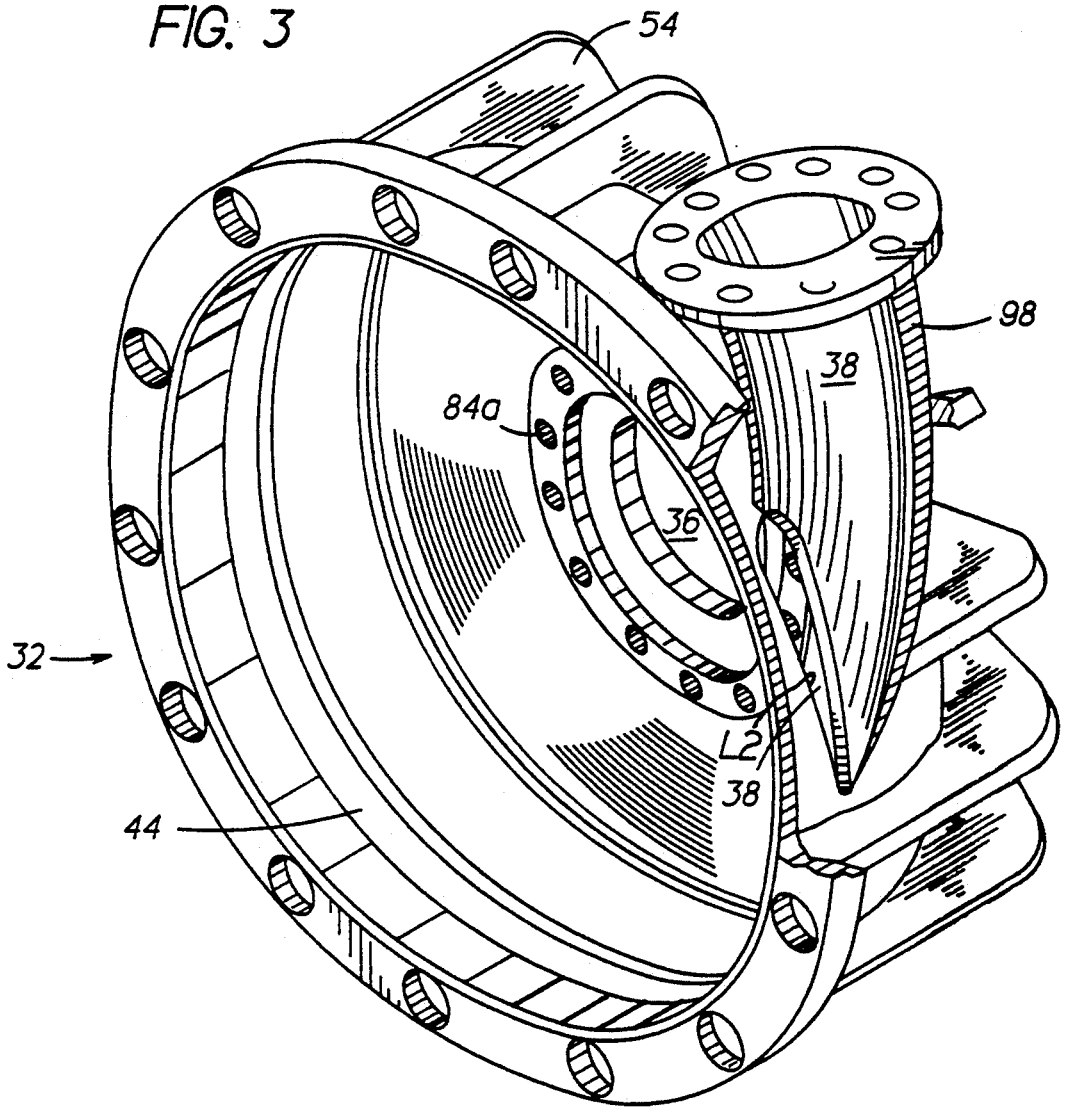
FIG. 3 is a partial prospective view of the pressure vessel, showing the interior of the pressure vessel and a discharge passage or nozzle from the pressure vessel.

FIG. 3 is a perspective view of the outer pressure vessel 32 shown in FIG. 1 showing in more detail the interior of the outer pressure vessel. As can be seen, shapes on the interior of the outer pressure vessel are relatively simple and may be easily machined. The first passage 38 extends through the pressure vessel and is bounded by a duct 98.

During operation of the rotary machine shown in FIG. 1, the working medium fluid is flowed via the inlet passage 36 through the outer pressure vessel 32 to the inlet 16 of the centrifugal impeller 12. The working medium fluid enters the impeller at a pressure of less than approximately five hundred pounds per square inch.

The impeller 12 is driven about the axis of rotation $A_r$. The motion of the impeller drives the working medium fluid radially outwardly, causing an increase in pressure to approximately eight thousand pounds per square inch at the discharge region 20 of the centrifugal impeller. The working medium fluid is discharged with a circumferential component of velocity. The guide vanes 92*a*, 92*b* direct the flow in a circumferential direction causing the flow to enter the volute or manifold housing 56. As the flow travels circumferentially in the volute, it is directed toward the exit opening $L_2$ of the volute. The collected flow is discharged via the third passage 84 through the projection to the first passage 38 in the pressure vessel 32 and thence to the exterior of the pressure vessel.

The outer pressure vessel 32 contains the pressurized fluid within the centrifugal pump 10. Accordingly, the outer pressure vessel bounds the first pressure region 58 and second pressure region 62 on the interior of the centrifugal pump. As the flow is discharged from the centrifugal impeller 12, a portion of the flow moves along the flow path $F_1$ via the opening 86 in the first sidewall (or "flow guide") into the first pressure region. The first pressure region has a pressure that is approximately eight thousand pounds per square inch. An additional amount of flow from the impeller is flowed to the second pressure region 62. The second pressure region may operate at a pressure of five hundred pounds per square inch if the region is vented as discussed above; or, the second pressure region may operate at a pressure of approximately eight thousand pounds per square inch if not vented. The pressures of these regions acting on the sidewalls of the housing decrease the cross pressure between the interior of the volute (the second passage 68) and the pressure on the exterior of the volute. Tensile stresses in the guide vane are decreased in comparison to constructions which do not have a pressurized region on the side of a volute. As a result of the decreased tensile stresses in the vane, the leading edge of the vane shown FIG. 2 may be made thinner, increasing the aerodynamic performance of the pump.

An assembly fit that is axially tight is created between the engagement of the first sidewall 64 with the disk-shaped member 42 at location A. This causes a deflection of the first sidewall which compresses the vanes 92*a*, 92*b* at assembly. Under operative conditions, the first sidewall 64 of the housing deflects outwardly, relieving the compressive stress but having a reduced level of tensile stress in comparison to constructions which do not compressively pre-load the vanes and sidewall.

An axially tight fit is also possible at the second sidewall 66 between the first portion 24 of the stator assembly and the second portion 54 of the stator side assembly. This provides the option of a further compressive stress on the second sidewall at assembly. The second sidewall is much thicker in the axial direction then the first sidewall because of the large pressure difference of approximately seven thousand pounds per square inch between the interior of the volute and the second pressure region 62. The pressure in the second pressure region is reduced in this embodiment to five hundred pounds per square inch to further reduce the stresses in the retention bolts 52 which attach the outer pressure vessel 32 to the remainder of the second portion of the stator assembly.

As noted, the first sidewall 64 or flow guide is spaced axially forwardly from the impeller leaving a third region 102 therebetween. The third region, through which the flow path $F_1$ extends, provides a pressurized region of high pressure fluid that applies an axial load on the impeller to help balance the thrust loading on the impeller from the turbine area of the pump.

Another advantage of the present invention is the ability to form the outer pressure vessel 32 as a forging by machining the final configuration, which is relatively simple, out of the forging. As a result, the forged pressure vessel has better tensile strength, elongation, and creep resistance than it would have if it was formed of a cast construction. This enables using the outer pressure vessel to preload the vanes 92*a*, 92*b* and the sidewalls 64, 66 of the inner housing for lower operational stress levels in the manifold housing.

The manifold housing (volute) 56 may be a cast structure which is cast integral with the outer housing. For example, the outer pressure vessel might have projections extending inwardly around which the manifold housing is cast to form an integral structure. In the embodiment shown, the manifold housing is a free-standing structure with respect to the outer pressure vessel. As a result of the first sidewall being deflected inwardly, tensile stresses in the sidewall are decreased, decreasing the stress loading on the first sidewall. As a result, the inner flow guide may be cast, providing the ability to easily fabricate shapes of complex geometry. These include the vanes 92*a*, 92*b* that guide the flow to the exit. And, as mentioned earlier, minimizing the cross-pressure using the first and second pressure regions and forming a compressive stress in the guide vanes by deflecting the first wall with respect to the second sidewall reduces the stress in the guide vane in comparison with other constructions not having such features. This results in a thin leading edge and a generally thih vane increasing the aerodynamic performance of the pump in comparison to constructions having higher stresses in the guide vane.

Although the invention has been shown and described with respect to detailed embodiments thereof, it should be understood by those skilled in the art that various changes in form and detail thereof may be made without departing from the spirit and scope of the claimed invention.

We claim:

1. A stator assembly for a rotary machine having a centrifugal impeller disposed about an axis of rotation $A_r$ and a discharge region for the impeller radially outwardly of the impeller, which comprises:

a first portion of the stator assembly which includes an outer pressure vessel extending circumferentially about the axis $A_r$ and which is spaced radially from the centrifugal impeller leaving an annular cavity therebetween, the pressure vessel including a passage for pressurized fluid discharged from the impeller which is in flow communication with the cavity;

a second portion of the stator assembly which includes a manifold housing disposed in the cavity and dividing the cavity into a first pressure region and a second pressure region, the manifold housing having a first sidewall and a second sidewall extending radially and circumferentially about the housing, the walls being spaced apart leaving a second circumferentially extending passage therebetween which is in flow communication with the discharge region of the impeller, the manifold housing including a base which is circumscribed by the outer pressure vessel and which has a third passage extending therethrough for placing the circumferentially extending passage in the manifold housing between the sidewalls, in flow communication with the passage in the outer pressure vessel;

the first sidewall extending radially inwardly from the base and being spaced axially from at least part of the outer pressure vessel to bound part of the first pressure region;

the second sidewall extending radially inwardly from the base and being spaced axially from at least part of the first portion of the stator assembly to bound part of the second pressure region, the second pressure region being in flow communication with the discharge region of the impeller; and a guide vane which is circumferentially oriented and which extends axially between the first sidewall and second sidewall to divide at least a portion of the second circumferential passage in the manifold housing into an inner part and an outer part;

wherein the first and second pressure regions are pressurized under operative conditions to decrease the difference in pressure between the passage in the manifold housing and the exterior of the manifold housing in comparison to constructions having a lower pressure in regions adjacent to the first sidewall and second sidewall and to dispose regions adjacent the outer pressure vessel of lower pressure in comparison to the pressure on the interior of the manifold housing.

2. The stator assembly of claim 1 wherein the manifold housing is integral with the outer pressure vessel.

3. The stator assembly of claim 2 wherein the pressure vessel has at least one projection into the cavity and the manifold housing extends about the projection.

4. The stator assembly of claim 1 wherein the sidewalls are spaced apart by a distance $L_u$ in the non-installed condition and by a distance $L_i$ in the installed condition to cause compressive pre-stresses in at least one of the walls in the installed non-operative condition.

5. The stator assembly of claim 1 wherein the first sidewall engages the outer pressure vessel and has an opening therein which places the first pressure region in flow communication with the discharge region of the impeller.

6. The stator assembly of claim 1 wherein the manifold housing is free standing in the non-installed condition.

7. The stator assembly of claim 6 wherein the manifold housing is press fit in the radial direction against the outer pressure vessel.

8. The stator assembly of claim 6 wherein the sidewalls are spaced apart by a distance $L_u$ in the non-installed condition and by a distance $L_i$ in the installed condition to cause compressive pre-stresses in at least one of the walls in the installed non-operative condition.

9. The stator assembly of claim 8 wherein the first sidewall engages the outer pressure vessel and is deflected axially in the installed condition.

10. The stator assembly of claim 9 wherein the first sidewall has an opening therein which places the first pressure region in flow communication with the discharge region of the impeller.

11. The stator assembly of claim 10 wherein the second sidewall engages the first portion of the stator assembly.

12. The stator assembly of claim 11 wherein the base has a projection extending circumferentially about a portion of the manifold housing and extending axially from the base to abuttingly engage the outer pressure vessel, the projection having the third passage extending therethrough which places the passage in the manifold housing in flow communication with the passage in the outer pressure vessel.

13. The stator assembly for a rotary machine of claim 1 wherein the pressure vessel is a forged construction and the manifold housing is a cast construction.

14. A stator assembly for a rotary machine having a centrifugal impeller disposed about an axis of rotation $A_r$ and a discharge region for the impeller radially outwardly of the impeller, which comprises:

a first portion of the stator assembly which includes an outer pressure vessel extending circumferentially about the axis $A_r$ and which is spaced radially from the centrifugal impeller leaving an annular cavity therebetween, the pressure vessel including a first passage for pressurized fluid discharged from the impeller which is in flow communication with the cavity, and, a disk-shaped side, an axial wall which is cylindrically shaped and which extends axially from the side, having a circumferentially extending flange for attaching the pressure vessel to adjacent structure, the pressure vessel further including a plurality of circumferentially spaced and radially extending ribs that reinforce the pressure vessel;

a second portion of the stator assembly which includes a manifold housing disposed in the cavity and dividing the cavity into a first pressure region and a second pressure region, the manifold housing being free-standing in the non-installed condition and having a first sidewall and a second sidewall extending radially and circumferentially about the housing, the walls being spaced apart by a distance $L_i$ in the installed condition leaving a second circumferentially extending passage therebetween which is in flow communication with the discharge region of the impeller, the manifold housing including a base having an outwardly facing surface which radially engages the outer pressure vessel and a shoulder having an axially facing surface which axially engages the outer pressure vessel, a projection extending circumferentially about a portion of the manifold housing and extending axially from the base to abuttingly engage the outer pressure vessel, the projection having a third passage extending therethrough which places the circumferentially extending passage in the manifold housing between the walls in flow communication with the passage in the outer pressure vessel, the first sidewall extending radially inwardly from the base to engage the outer pressure vessel, being spaced axially from part of the outer pressure vessel to bound part of the first pressure region and having an opening therein which places the first pressure region in flow communication with the discharge region of the impeller, the second sidewall extending radially inwardly from the base to engage the first portion of the stator assembly and being spaced axially from part of the first portion of the stator assembly to bound part of the second pressure region, the second pressure region being in flow communication with the discharge region of the impeller, and a guide vane which is circumferentially oriented and which extends axially between the first sidewall and second sidewall to divide at least a portion of the second circumferential passage in the manifold housing into an inner part and an outer part;

wherein at least one of said sidewalls is deflected relative to the other in the installed condition such that the distance $L_i$ between the walls in the installed condition is less than the distance $L_u$ in the non-installed condition to cause compressive prestresses in at least one of the walls in the installed, non-operative condition and wherein the first and second pressure regions are pressurized under operative conditions to decrease the difference in pressure between the passage in the manifold housing and the exterior of the housing in comparison to constructions having a lower pressure in regions adjacent to the first sidewall and second sidewall.

* * * * *